US005247288A

United States Patent [19]

Warren et al.

[11] Patent Number: 5,247,288

[45] Date of Patent: Sep. 21, 1993

[54] HIGH SPEED ADDRESSING METHOD AND APPARATUS FOR INDEPENDENT SUSTAIN AND ADDRESS PLASMA DISPLAY PANEL

[75] Inventors: Kevin W. Warren, Champaign, Ill.; Larry F. Weber, New Paltz, N.Y.

[73] Assignee: Board of Trustees of University of Illinois, Urbana, Ill.

[21] Appl. No.: 818,407

[22] Filed: Jan. 3, 1992

Related U.S. Application Data

[63] Continuation of Ser. No. 433,025, Nov. 6, 1989, abandoned.

[51] Int. Cl.[5] ..... G09G 3/22

[52] U.S. Cl. ..... 345/60; 345/67; 345/68

[58] Field of Search ..... 340/771, 776, 775, 805; 315/169.4

[56] References Cited

U.S. PATENT DOCUMENTS

| | | | |
|---|---|---|---|
| 3,559,190 | 1/1971 | Bitzer et al. | 340/173 |
| 4,063,223 | 12/1977 | Shlig et al. | 340/709 |
| 4,595,919 | 6/1986 | Holz et al. | 340/776 |
| 4,772,884 | 9/1988 | Weber et al. | 340/776 |
| 4,866,349 | 9/1989 | Weber et al. | 340/776 |

OTHER PUBLICATIONS

Lee et al., "High Speed Asynchronous Video Addressing of ac-Plasma Display Incorporating Brightness Control", SID 86 Digest, 1986, pp. 399-402.

Bruce C. Anderson and Vernon J. Fowler, "AC Plasma Panel TV Display with 64 Discrete Intensity Levels", SID International Symposium, 178, pp. 28-29.

*Primary Examiner*—Ulysses Weldon

*Attorney, Agent, or Firm*—Perman & Green

[57] ABSTRACT

A method for driving an Independent Sustain/Address line (ISA) AC plasma display panel comprises the steps of: energizing address and sustain lines to turn on all four pixel cells in a cell group; applying an erase pulse to an address cell to cause a first coupling cell in the cell group to have wall charges deposited therein; applying next, a preset duration potential between intersecting sustain lines, one sustain line intersecting the first coupling cell and firs and second adjacent pixel cells, to migrate electrons from a discharge of the first coupling cell to a first adjacent pixel cell to erase the pixel cell, such potential further causing an "on" pixel cell adjacent to the first coupling cell to discharge; applying next, another erase pulse to an address cell, to cause a different coupling cell to have wall charges deposited therein; and applying next, a lesser duration potential than the preset duration potential, between a pair of intersecting sustain lines to migrate the deposited wall charges to a pixel cell adjacent the different coupling cell to erase to pixel cell, such lesser duration potential being insufficient to cause another pixel cell adjacent the different coupling cell to discharge.

8 Claims, 19 Drawing Sheets

HIGH SPEED ADDRESSING METHOD AND APPARATUS FOR INDEPENDENT SUSTAIN AND ADDRESS PLASMA DISPLAY PANEL

This is a continuation of copending application Ser. No. 07/433,025 filed on Nov. 6, 1989 now abandoned.

FIELD OF THE INVENTION

This invention relates to independent sustain and address AC plasma display panels, and more particularly to high speed addressing methods and apparatus for such panels.

BACKGROUND OF THE INVENTION

Plasma display panels, or gas discharge panels, are well known in the art and, in general, comprise a pair of transparent substrates respectively supporting column and row electrodes, each coated with a dielectric layer and disposed in parallel spaced relation to define a gap therebetween in which an ionizable gas is sealed. The substrates are arranged such that the electrodes are disposed in orthogonal relation to one another thereby defining points of intersection which in turn define discharge cells at which selective discharges may be established to provide a desired storage or display function. It is also known to operate such panels with AC voltages and particularly to provide a write voltage which exceeds the firing voltage at a given discharge point, as defined by a selected column and row electrode, thereby to produce a discharge at a selected cell. The discharge at the selected cell can be continuously "sustained" by applying an alternating sustain voltage (which, by itself is insufficient to initiate a discharge). This technique relies upon the wall charges which are generated on the dielectric layers of the substrates which, in conjunction with the sustain voltage, operate to maintain discharges.

Details of the structure and operation of such gas discharge panels or plasma displays are set forth in U.S. Pat. No. 3,559,190 issued Jan. 26, 1971 to Donald L. Bitzer, et al.

AC plasma displays have found widespread use due to their excellent optical qualities and flat panel characteristics. These qualities have made plasma displays a leader in the flat-panel display market. However, plasma panels have gained only a small portion of their potential market because of competition from lower cost CRT products.

Various attempts have been made to reduce the costs inherent in AC plasma panel structures. One of the more successful is described in U.S. Pat. No. 4,772,884 and is entitled "Independent Sustain and Address Plasma Display Panel", by Weber et al. (one of the inventors hereof). That patent describes an electrode geometry change from the standard AC plasma technology wherein the address and sustain functions are carried out on separate panel electrode structures. Separating those two functions has enabled implementation of both a different addressing scheme and provided reductions, by a factor of two, in the number of required address drivers (as compared to the number required for the standard AC plasma technology). Furthermore, the address drivers did not have to supply sustain currents and could be made much smaller and therefore less expensive.

In FIG. 1, an 8×8 pixel, independent sustain and address (hereinafter called "ISA") plasma panel schematic is shown. FIG. 2 shows an expanded view of the area in circle 10 in FIG. 1. The expanded view in FIG. 2 shows a basic nine cell group that is the repetitive unit in the ISA geometry. Each of the nine cells is defined in accordance with the types of electrodes that intersect to define a cell. In plasma panels existing prior to the ISA technology, all cells on the panel were electrically identical and, in fact, were all display pixels. However, in an ISA panel, only four of the nine cells of a cell group are display pixels i.e. P1, P2, P3, and P4. Those pixel cells are located at the intersections of four sustain electrodes XSa, XSb, YSa, and YSb. In addition to the four pixel cells, there are five other cells in a cell group. At the center of the cell group is an address cell A which occurs at the intersection of two address electrodes XA and YA. There are also four coupling cells: C1, C2, C3, and C4 which occur at the intersections of a sustain electrode and an address electrode. The coupling cells are divided into two groups depending upon their position relative to the address cell. The C1 and C4 cells are called vertical coupling cells and the C2 and C3 cells are called horizontal coupling cells. It should be understood, that the terms vertical and horizontal are used merely to designate orthogonal orientations of conductors and cells and for easy reference purposes.

All horizontal electrodes of the ISA panel reside on one substrate of a panel and are referred to as the Y electrodes. All vertical electrodes reside on an opposite substrate and are termed X electrodes. As is well known, between the substrates, an ionizable gas is positioned and provides the selected cell illumination. The X address electrodes comprise electrodes 12, 14, 16 and 18 whereas the Y electrodes comprise 20, 22, 24, and 26. Each X electrode can be selectively addressed by a column address and driver circuit 28 and each Y address line can be addressed by a row address driver circuit 30.

X sustain signals are provided by two, phased, sustain generators 32 and 34, with each of the aforementioned sustain generators coupled to a connected pair of parallel sustain lines (e.g. 36, 38). Each pair of sustain lines, e.g. 36, 38, is shorted together by shorting bars at either end, thus forming a sustain electrode pair. Alternating sustain electrode pairs on a given substrate are bussed together by a sustain bus and are connected to one of the two sustain drivers. Row sustain drivers 40 and 42 are similarly connected to interspersed row sustain pairs.

In FIG. 3, waveforms are shown which describe a basic cycle for an ISA plasma panel as described in the aforementioned U.S. Pat. No. 4,772,884. In a preferred mode of operation, two rows of pixel cells are initially turned on. Then, an erase cycle is performed to selectively turn off pixels which the image data indicate should be in the off state. The waveforms of FIG. 3 assume that a "write two rows" cycle has already occurred. The selective erase of certain desired "on" pixels encompasses two steps. The first step causes a discharge to occur in selected address cells along a selected YA address electrode (see FIG. 2). This results in the migration of wall charges into vertical coupling cells C1 and C4.

This is described in more detail by the waveform diagram of FIG. 3. Prior to the selective erase occurring, reset pulses are applied to the X and Y address lines to reset the wall voltages in vertical coupling cells C1 and C4. The simultaneous application of sustain voltages to XSa, XSb and YSa, YSb sustain lines with the reset pulses will cause small discharges to occur in the coupling cells which serve to adjust their wall voltages.

Subsequently, erase address pulses 50 and 52 are applied to the XA and YA address lines respectively. This commences Step 1 of the selective erase procedure and its effect is shown in FIG. 4. The erase address waveforms are polarized so that the XA and YA electrodes are the anode and cathode respectively. Since the XA electrode is the anode, the plasma discharge 54, which occurs at address cell A, spreads predominantly towards vertical coupling cells C1 and C4. The voltage across the gaps in each of coupling cells C1 and C4 is such that the spreading plasma deposits significant negative charge into these cells. In FIG. 5, a sectional illustration taken along line 5—5 in FIG. 4 (Step 1) is shown and illustrates the plasma spreading activity during Step 1 and the charges on the inner walls that are present at coupling cells C1 and C4 and address cell A.

Step 2 of the selective erase address performs two degrees of selection. It commences at the fall of erase address pulses 50 and 52 and the rise of certain selection potentials on the sustain electrodes. As shown in FIG. 5, Step 1 deposited equal amounts of wall charge into coupling cells C1 and C4 when address cell A was discharged. By raising only a Y sustain line associated with a selected vertical coupling cell, the unselected vertical coupling cell, defined by the non-raised Y sustain line, will not discharge.

During Step 2, the selected YS and XS electrodes are the anode and cathode respectively. This polarization enables the plasma generated by the discharge of a coupling cell to spread horizontally away from the cell and into neighboring pixel cells. Sectional views taken along line 6—6 in FIG. 4 (Step 2) are shown in FIGS. *6a–6d* and further aid in understanding the operation of the selective erase. In FIG. 3, the waveforms impressed on the X and Y sustain lines during Step 2 enable the selection of which of the pixel cells is to be erased.

In FIG. *6a*, it is assumed that Step 1 has already occurred; that coupling cell C1 has substantial wall charges which are polarized to provide a more positive voltage under the YSa electrode; and that both pixel cells P1 and P2 are in the on state. At this point, it is desired to erase the P1 cell while leaving the P2 cell in its on state. Thus, 100 volt potentials are applied to the XSa and YSa electrodes respectively, and zero volts are placed on the XA and XSb electrodes. The stored wall charges in coupling cell C1 add to the applied potential on the YSa electrode to cause a discharge in cell C1. At the same time, there occurs a discharge in cell P2 but none occurs in cell P1 due to the fact that identical voltages exist on its bounding electrodes. The plasma which results from the discharge of cell C1 spreads along the YSa electrode and neutralizes any preexisting wall charges in cell P1, thereby causing it to be erased. Since cell P2 is already discharged, the migration of additional charge states thereinto has no effect.

In FIG. *6c*, a different set of initial conditions are assumed. In this case, cell P2 is in the off state and cell P1 is to be erased without affecting the state of cell P2. Since the dielectric immediately beneath the YSa electrode in cell P1 has a positive wall charge, the electrons resulting from a subsequent discharge of coupling cell C1 preferentially migrate thereto and neutralize the preexisting wall charge. Preexisting negative wall charges in pixel cell P2 tend to repel the electrons resulting from the discharge in coupling cell C1 and cell P2 remains unaffected. Thus it can be seen, that the sustain line that is raised during Step 2 of the selective erase, determines the type of pixel cell that will be erased. Therefore, to erase a selected type of pixel cell, the two sustain electrodes that define the selected pixel cell type should rise simultaneously, following the fall of the XA address pulse.

As a consequence of reducing the number of address drivers by a factor of two, the ISA plasma display panel, in its simplest form, is a factor of two slower in updating a given panel size, when compared to a standard AC plasma panel. Since there is only one address driver for each two rows or columns of pixels, the two selective erase cycles delay the overall operation of the panel. This factor becomes a problem when the number of rows of data or the frame update rate is high. If the frame update rate needs to be increased for any reason, the maximum number of rows of data that can be displayed is accordingly decreased. Similarly, if the number of rows of display data is to increase beyond a maximum allowable for a given frame update rate, then the frame update rate must be decreased.

Furthermore, it is to be noted that subsequent to each selective erase cycle, previous ISA AC plasma panels have inserted one or more sustain cycles to stabilize the cell wall charges. Thus, in addition to the time taken to individually erase pixels in each cell group, sustain pulses are interspersed between the erase pulses and add to the overall addressing time. Additionally, the duration of the sustain pulses must be such as to assure the proper discharge of cells which are to remain in the "on" state. All of this, combined, adds significantly to the addressing time of the ISA AC plasma panel.

The above stated speed limitation presents problems. Applications which require the use of a mouse, pointer, or graphics frequently require relatively high frame update rates for continuous information display.

Additionally, the ability to effectively exhibit gray scale images depends, to a great extent, upon the speed the display image can be updated.

Accordingly, it is an object of this invention to provide an ISA AC plasma panel with an improved addressing scheme.

It is another object of this invention to provide an ISA AC plasma panel with a substantially increased speed, addressing scheme.

It is still another object of this invention to provide an ISA AC plasma panel with an improved addressing scheme which utilizes existing panel structures.

A still further object of this invention is to provide an ISA AC plasma display panel with a power conserving drive scheme.

Yet another object of this invention is to provide an ISA AC plasma panel with a variable brightness feature.

SUMMARY OF THE INVENTION

An improved method for driving an ISA AC plasma display panel is described. The panel comprises at least two cell groups, each cell group including an address cell, two vertical coupling cells, two horizontal coupling cells and four pixel cells. Horizontal and vertical address lines intersect at each address cell and parallel sustain lines are positioned, on either side of each address line and intersect parallel and adjacent series of pixel and coupling cells in each cell group. The improved driving method comprises:

A. energizing address and sustain lines to turn on all pixel cells in a cell group;

B. applying an erase pulse to an address cell to cause a first coupling cell to have wall charges deposited therein;

C. applying next, a preset duration potential between intersecting sustain lines, one sustain line intersecting the first coupling cell and first and second adjacent pixel cells, to migrate electrons from a discharge of the first coupling cell to a first adjacent pixel cell to erase the pixel cell, such potential further causing an "on" pixel cell adjacent to the first coupling cell to discharge;

D. applying next, another erase pulse to an address cell, to cause a different coupling cell to have wall charges deposited therein; and E. applying next, a lesser duration potential than the preset duration potential, between a pair of intersecting sustain lines to migrate the deposited wall charges to a pixel cell adjacent the different coupling cell to erase the pixel cell, such lesser duration potential being insufficient to cause another pixel cell adjacent the different coupling cell to discharge.

Another method for selective erase is disclosed wherein application of the lesser duration potential is obviated. Also, an erase technique is disclosed for conserving panel energy dissipation.

BRIEF DESCRIPTION OF THE DRAWINGS

FIGS. 18*a* and 18*b* are sectional views taken along line 18—18 in FIG. 17 and show the operation of the erase two rows method when pixel cells P1 and P3 are both on.

DETAILED DESCRIPTION OF THE INVENTION

Figure 1:
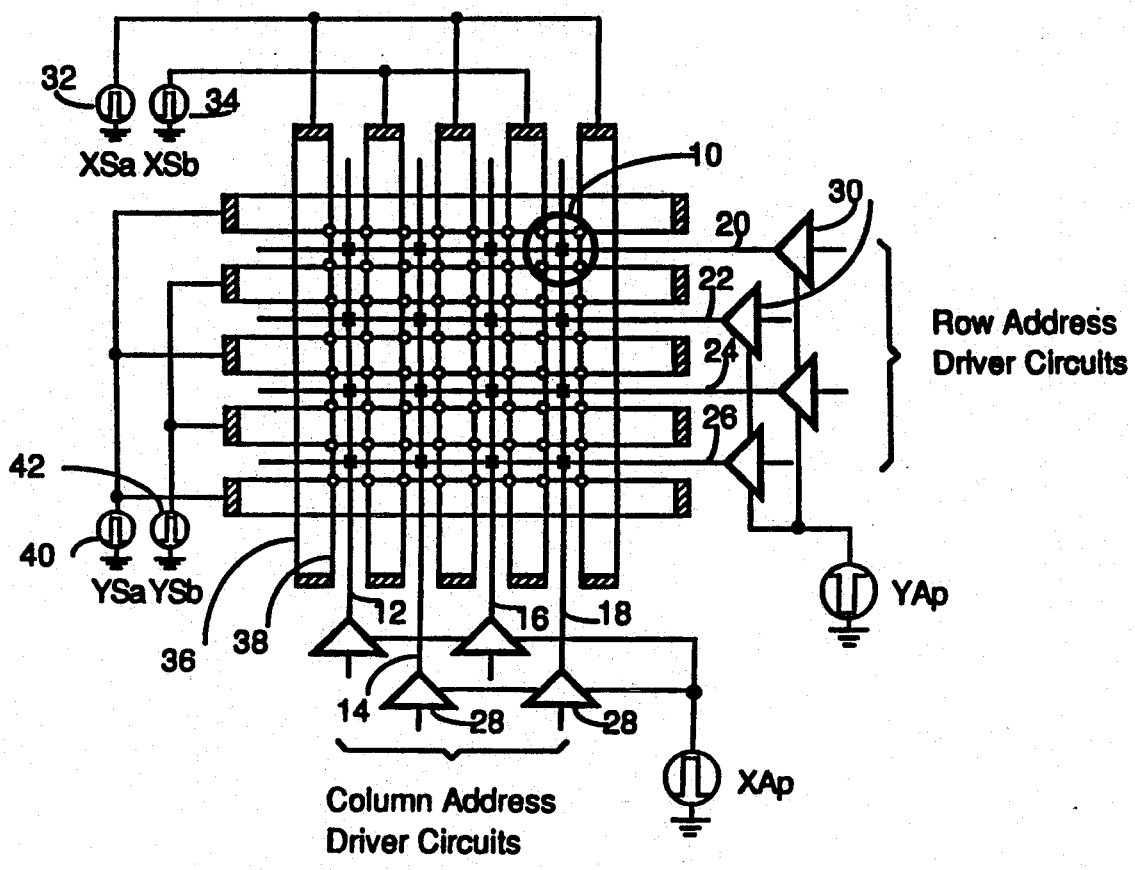
PRIOR ART Fig. 1
FIG. 1 is an exemplary circuit diagram of a prior art ISA AC plasma panel.
Figure 2:
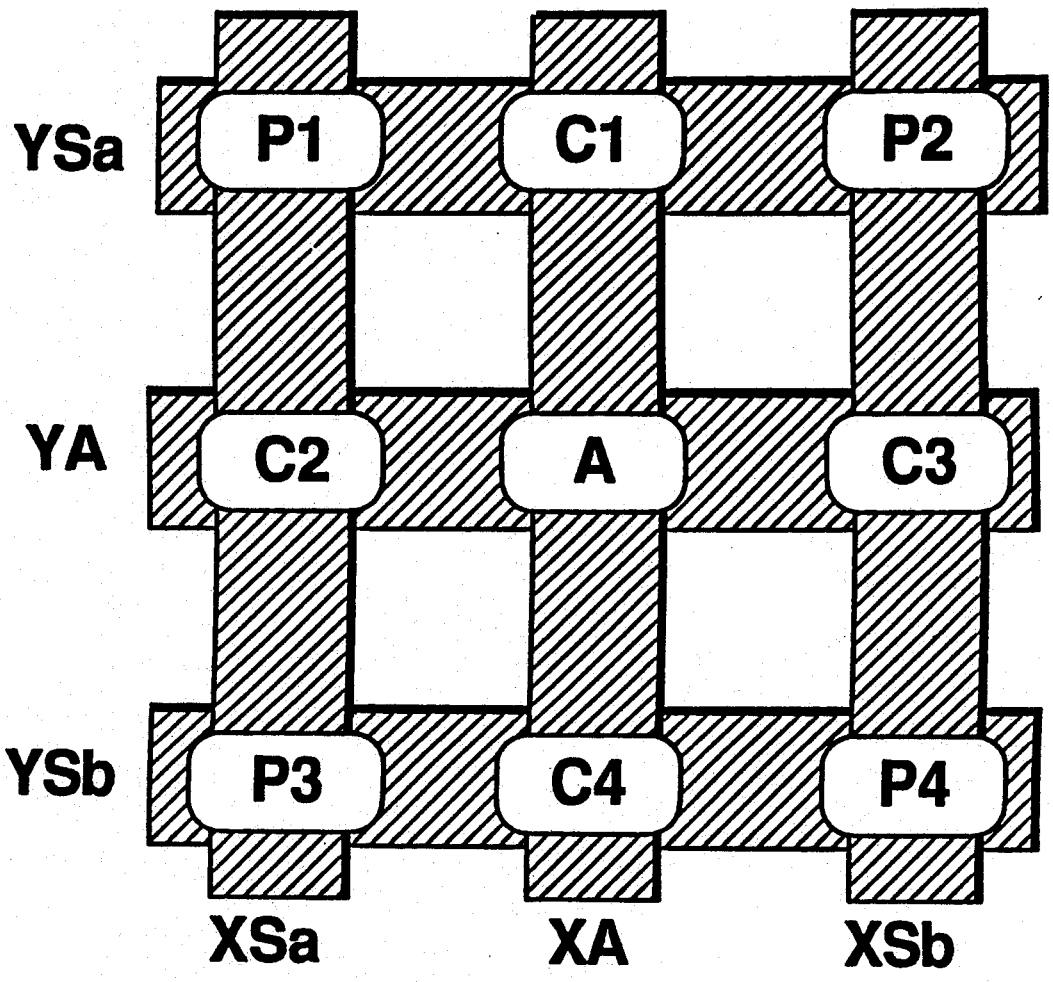
PRIOR ART Fig. 2
FIG. 2 is an expanded view of a cell group from FIG. 1.
Figure 3:
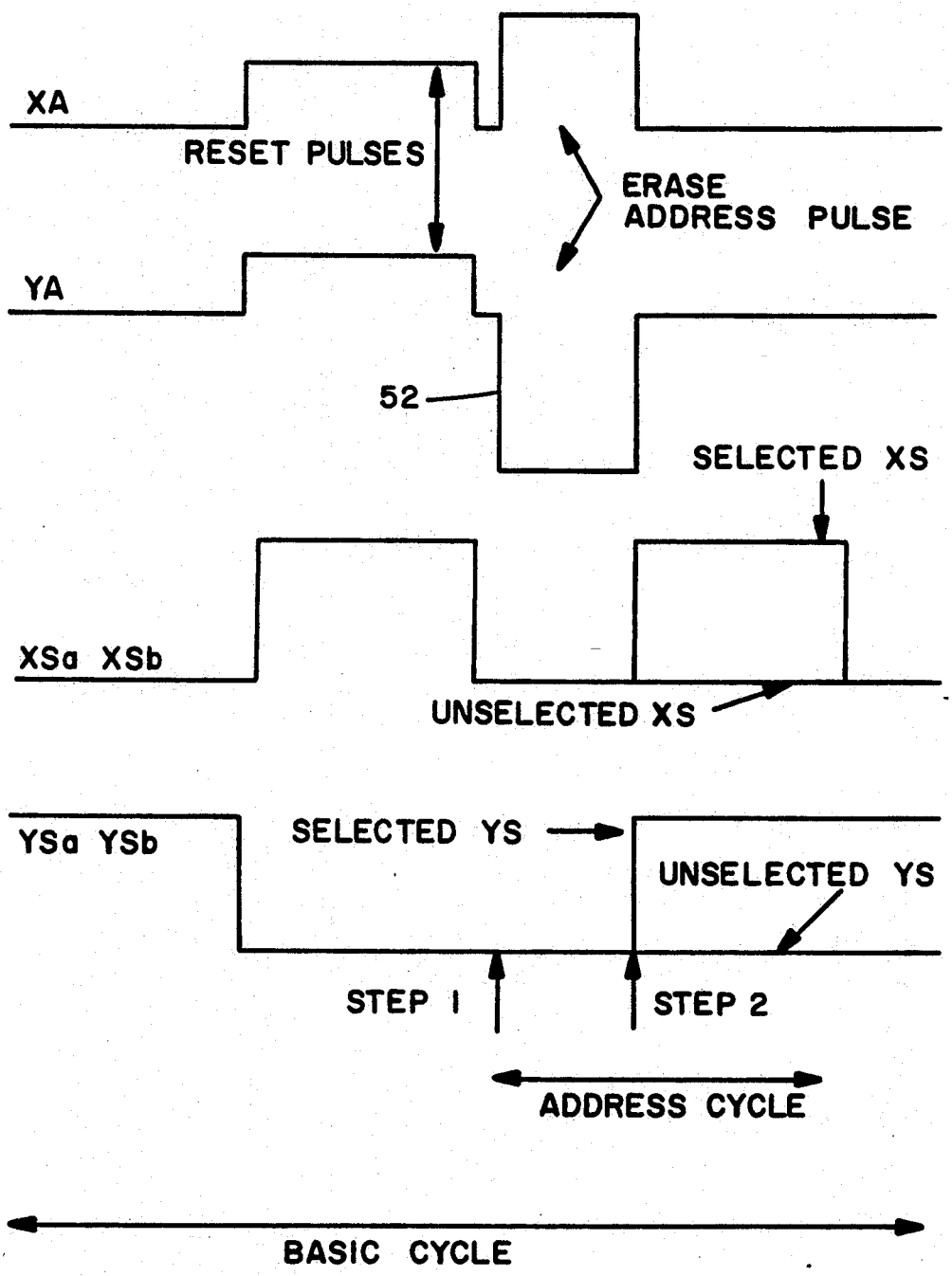
FIG. 3 PRIOR ART
FIG. 3 shows a set of waveforms used to erase selected pixels in the AC plasma panel of FIG. 1.
Figure 4:
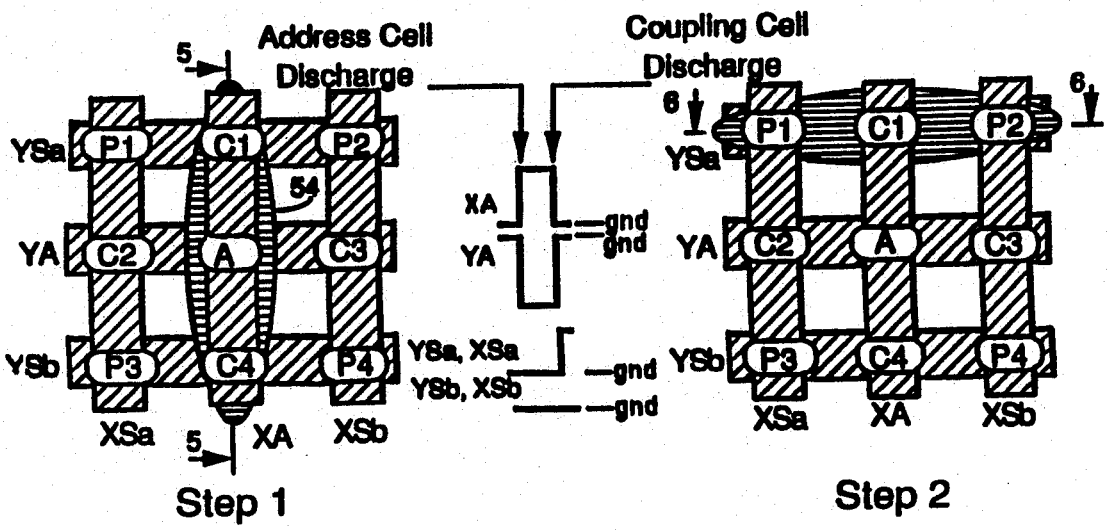
FIG. 4 illustrates the plasma spreading effects which occur during Step 1 and Step 2 of a selective erase cycle.
Figure 5:
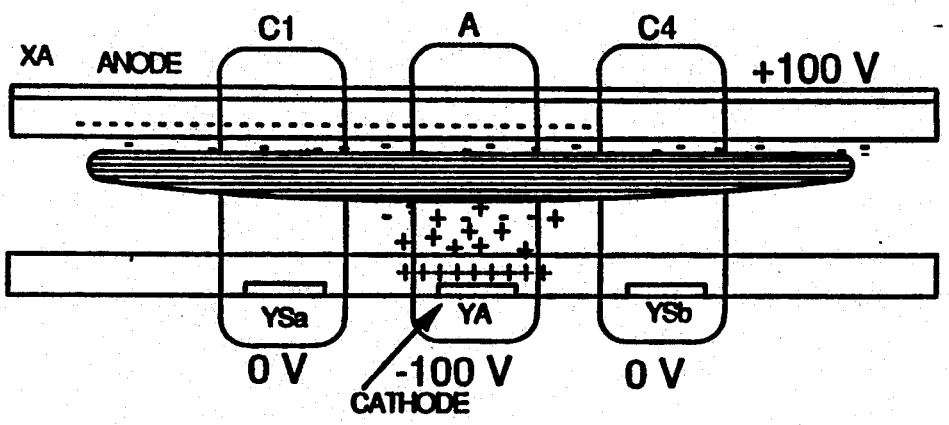
FIG. 5 is a section taken along line 5—5 in FIG. 4 (Step 1).
Figure 6A:
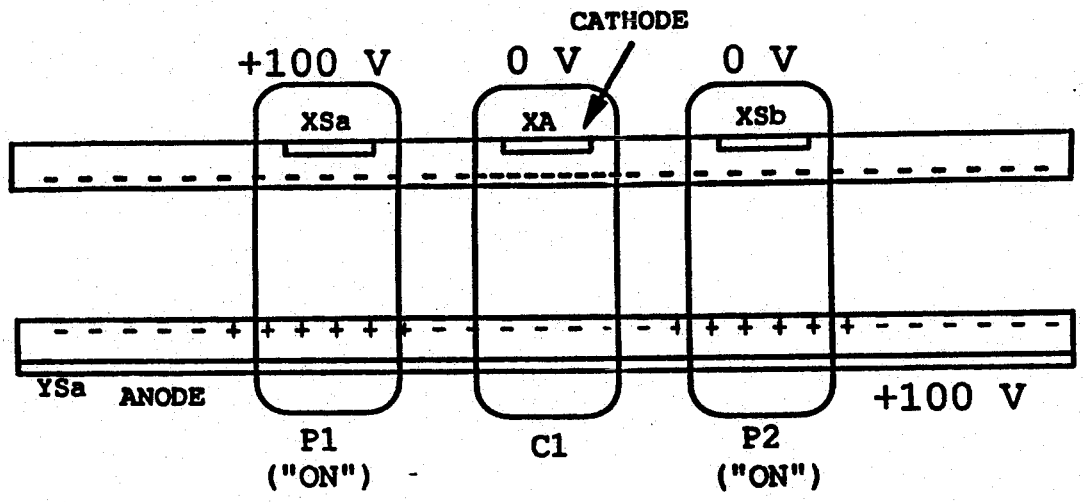
FIGS. 6*a* and 6*b* are sections taken along line 6—6 in FIG. 4 (Step 2), showing the operation of a Step 2 discharge to erase a P1 pixel cell while a P2 pixel cell is in the "on" state.
Figure 6B:
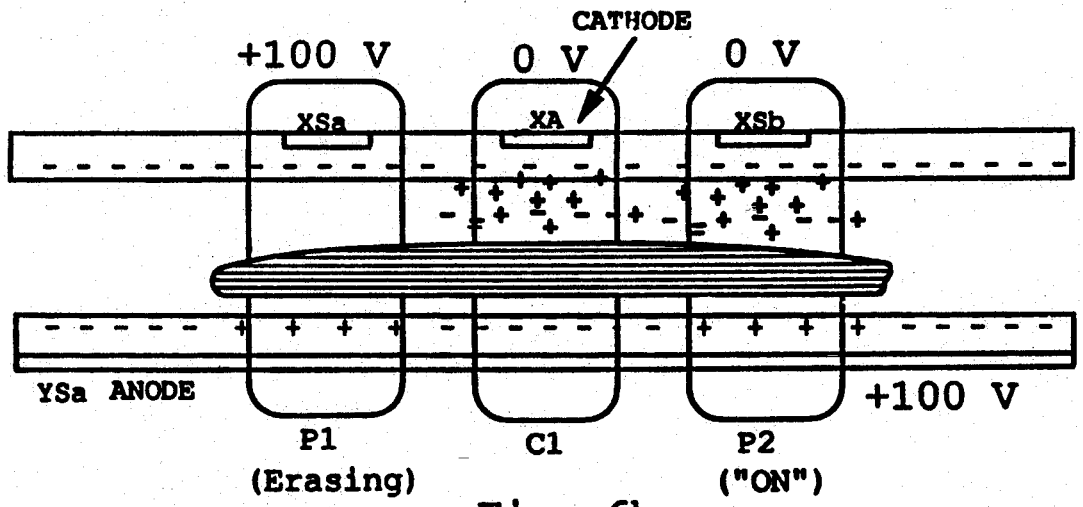
Figure 6C:
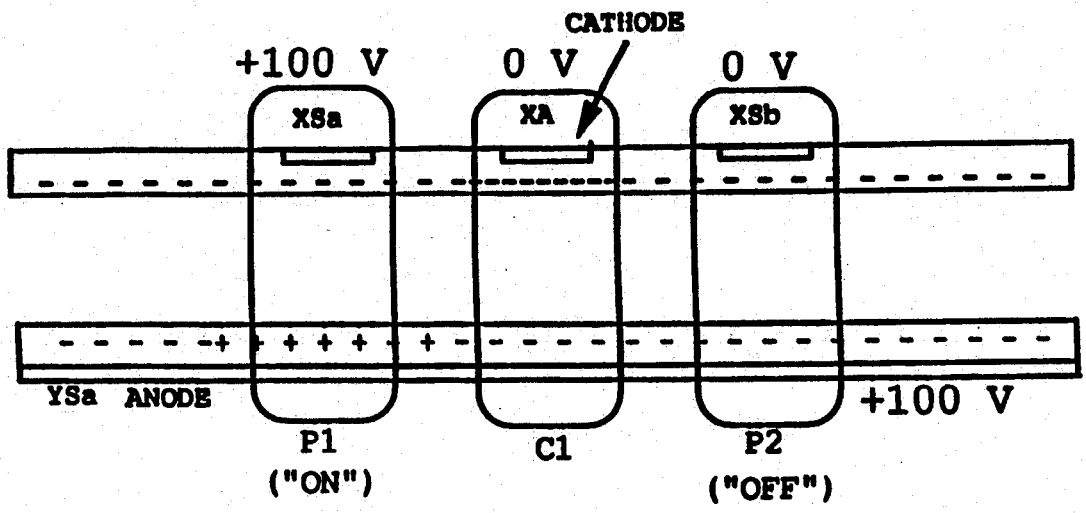
FIGS. 6*c* and 6*d* are sections taken along line 6—6 in FIG. 4 (Step 2), showing the operation of a Step 2 discharge to erase a P1 pixel cell while a P2 pixel cell is in the "off" state.
Figure 6D:
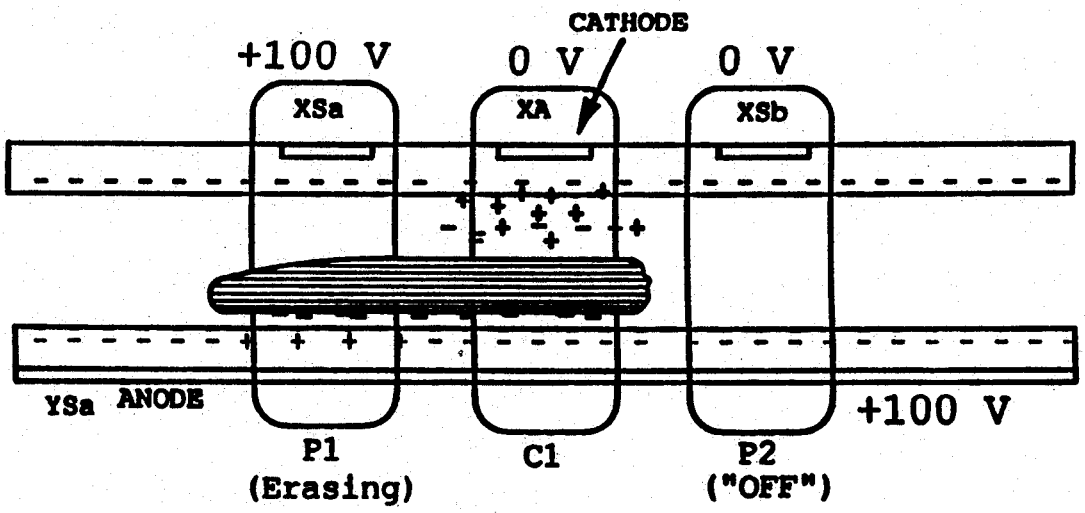
Figure 7:
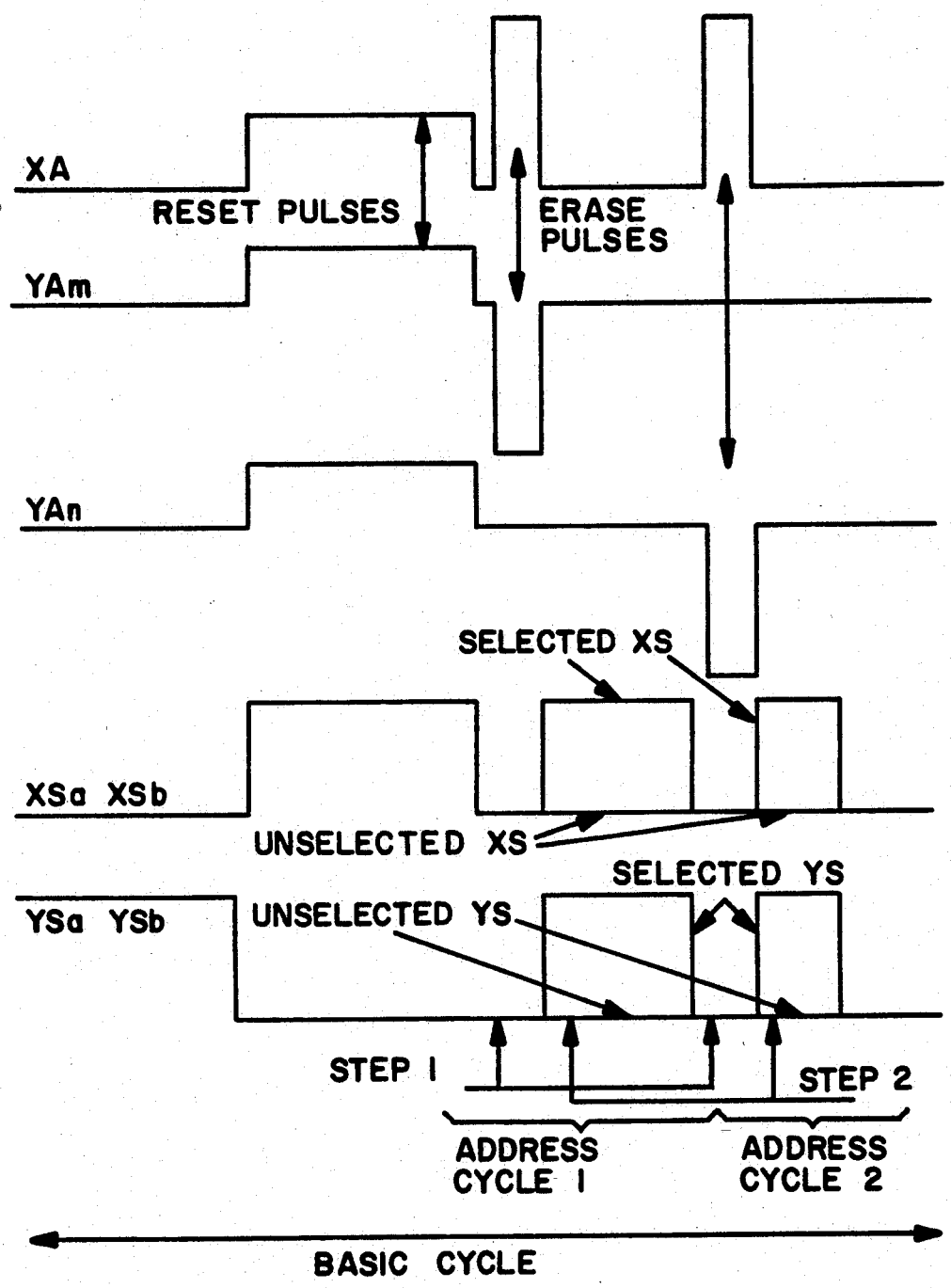
FIG. 7 is a waveform diagram which illustrates the general operation of the improved selective erase method employed by this invention.

This invention alters the prior art ISA plasma panel addressing method by performing multiple address cycles in a single "basic" cycle. A set of waveforms which illustrate a multiple address basic cycle approach for the ISA AC plasma panel is shown in FIG. 7. In summary, the procedure starts by writing all pixels in four (or more) lines. Then, one type of pixel is erased in a first line, followed by a half sustain cycle and subsequently, another type of pixel is erased in another line. The second erase is followed by a shorter sustain signal which may then continue to be used during subsequent erase events.

FIG. 7 illustrates the potentials applied to X dimension address line XA, to Y dimension address lines YAm and YAn, and to sustain pairs XSa, XSb, YSa, and YSb. Note that while there are two complete address cycles in the waveform diagram of FIG. 7, under normal circumstances there will be many more. Each address cycle has its own, independent Step 1 and Step 2. discharges similar to those described with respect to FIGS. 5 and 6*a*–6*d*. FIGS. 8–11 illustrate the sequence of events that take place in a multiple address, basic cycle and serve to illustrate the address operation at different times during a basic cycle. In each of FIGS. 8–11, a time line 200 is shown which will be stepped through the waveform diagram to highlight the operation which occurs in the cell groups at the indicated time.

Figure 8:
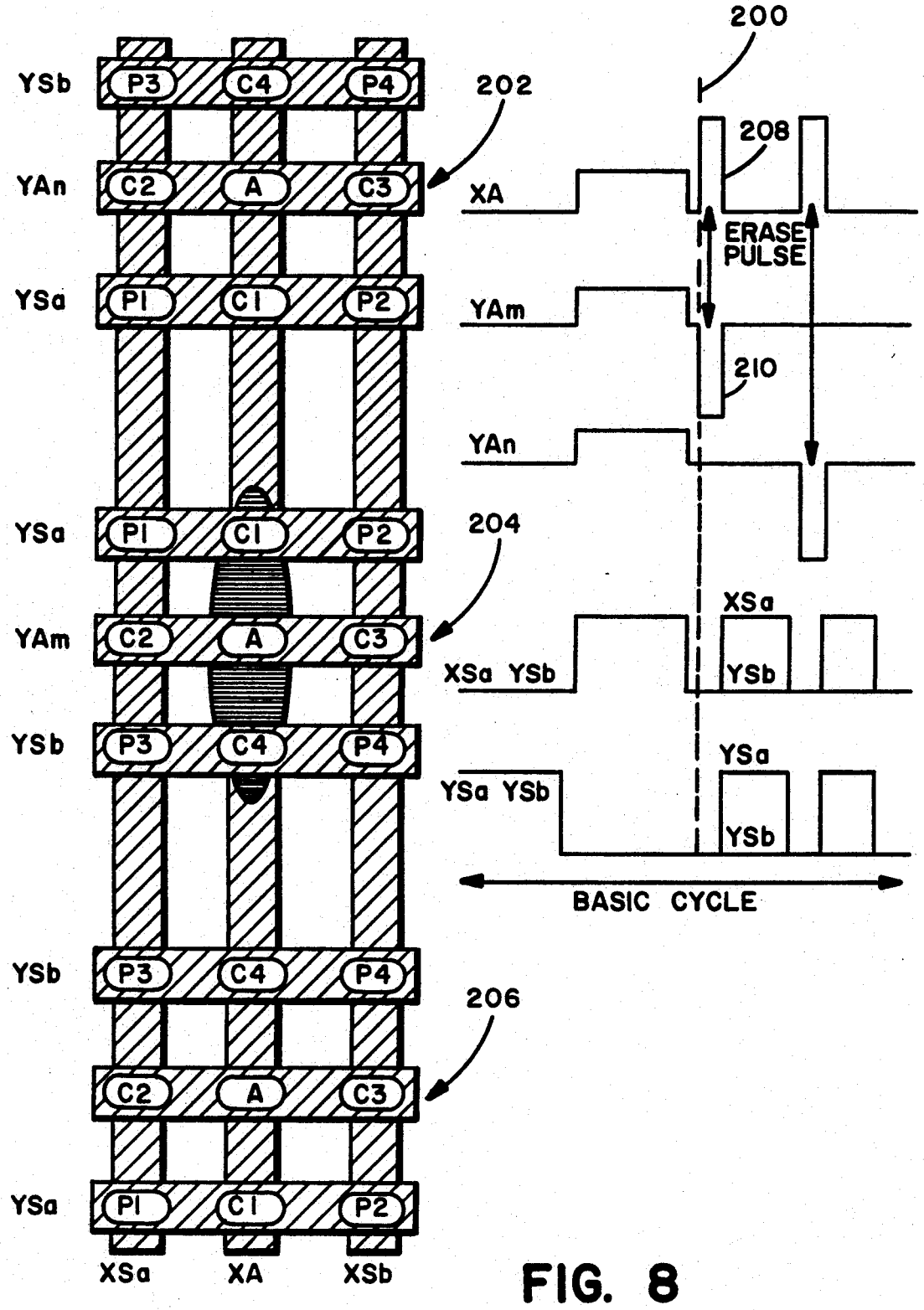
FIG. 8 illustrates three cell groups and a set of waveforms which cause a Step 1 discharge to take place at an address cell during the improved selective erase method.

In FIG. 8 it is initially assumed that four rows of contiguous pixel cells in cell groups 202 and 204 have been written into the "on" state. This is accomplished by bringing both the YAm and YAn address lines negative to discharge the associated coupling cells C2 and C3. As a result, wall charges spread into the adjacent pixel cells readying them for discharge during a subsequent sustain cycle. Thus, pixel cells P1, P2, P3, and P4 in cell groups 202 and 204 are "on". Initially, as above-stated with respect to the prior art addressing scheme, a plurality of reset pulses are applied to the address lines to adjust the coupling cell wall voltages. Subsequently, erase pulses 208 and 210 are impressed upon address lines XA and YAm to cause address cell A, in cell group 204, to discharge. That discharge causes a spreading of plasma 207 into vertical coupling cells C1 and C4 and causes wall charges to be deposited therein. In essence, this then describes the Step 1 discharge as above described.

Figure 9:
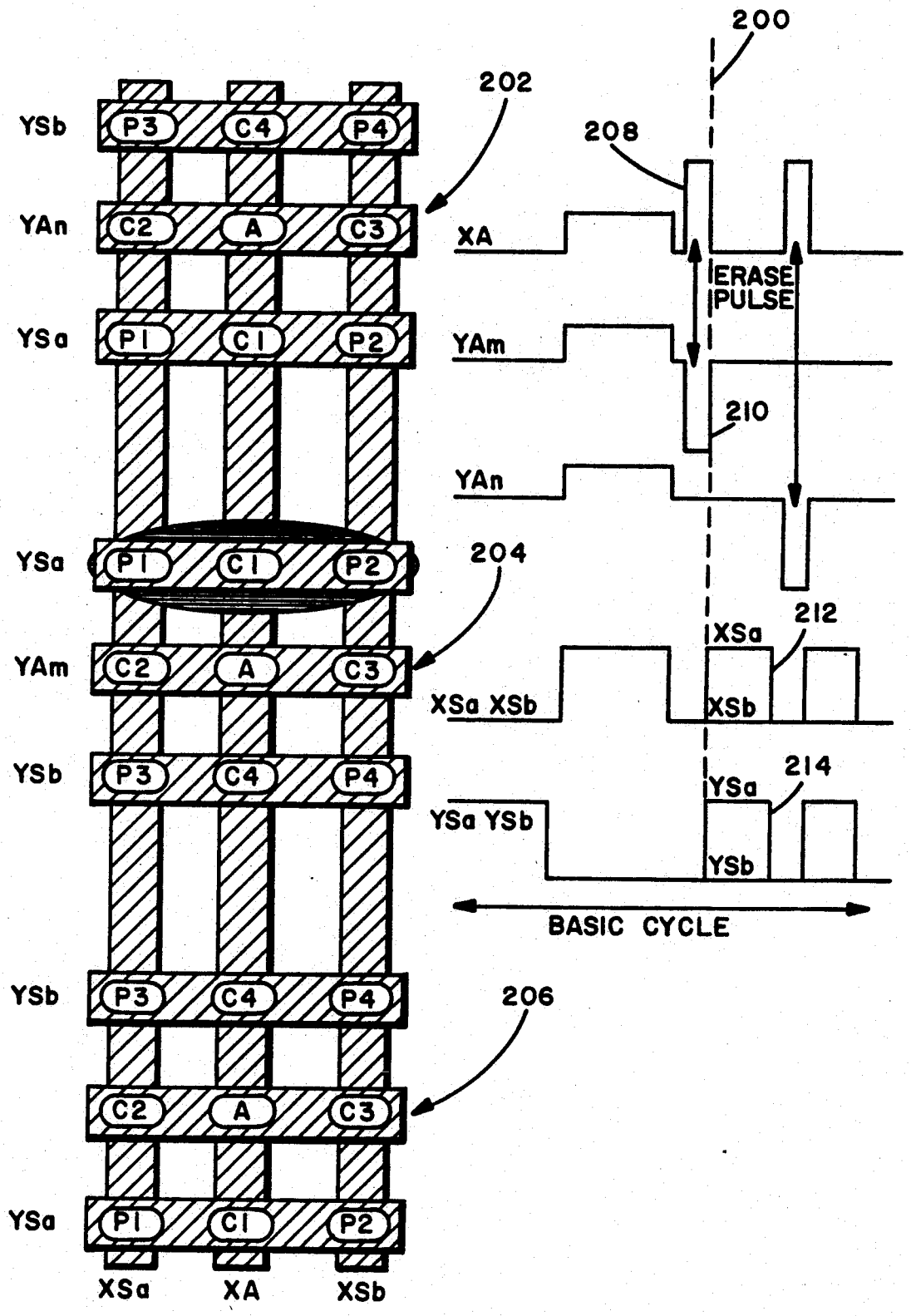
FIG. 9 is the same as FIG. 8 except that it illustrates a Step 2 discharge taking place later in the waveform diagram.

For exemplary purposes, the initial cell to be erased will be pixel cell P1; however, any of the other pixel cells can be selected as the first cell erased. Turning to FIG. 9, time line 200 has advanced and address pulses 208 and 210 fall to their down state. A pair of sustain voltages are now applied which will properly influence a plasma created by the discharge of vertical coupling cell C1 to erase cell P1.

As shown by waveforms 212 and 214, the XSa and YSa sustain lines are brought high while the XSb and YSb sustain lines remain low. When the XSa and YSa sustain lines go high, the previously deposited wall charges in coupling cell C1 in cell group 204 combine with the applied sustain potentials and cause C1 to discharge (in the manner of a Step 2 discharge described above). The electrons from the C1 cell discharge migrate to pixel cell P1 thereby causing its wall charges to be neutralized. Pixel cell P1 does not discharge, notwithstanding its previous "on" state, since there is a net zero voltage thereacross, and it is thereby erased by the migrating electrons. On the other hand, pixel cell P2 in cell group 204 does discharge due to the high level on YSa adding to the previous wall charges stored in pixel cell P2.

Sustain waveforms 212 and 214 must have a long enough duration to enable pixel cell P2 to properly discharge during this portion of the address cycle. Otherwise, pixel cell P2 might inadvertently be turned off during the erasure of pixel cell P1. In the prior art ISA addressing scheme, sustain pulses 212 and 214 are ordinarily followed by two additional sustain pulses of opposite polarity to completely reset and stabilize the remaining "on" pixel cells. In this case however, when pixel cell P2 discharges, its wall charges reverse state and are not reset by a subsequent sustain cycle. Thus, pixel cell P2 cannot be erased until it is subsequently reset by an additional sustain half cycle. This will be considered in further detail below.

Figure 10:
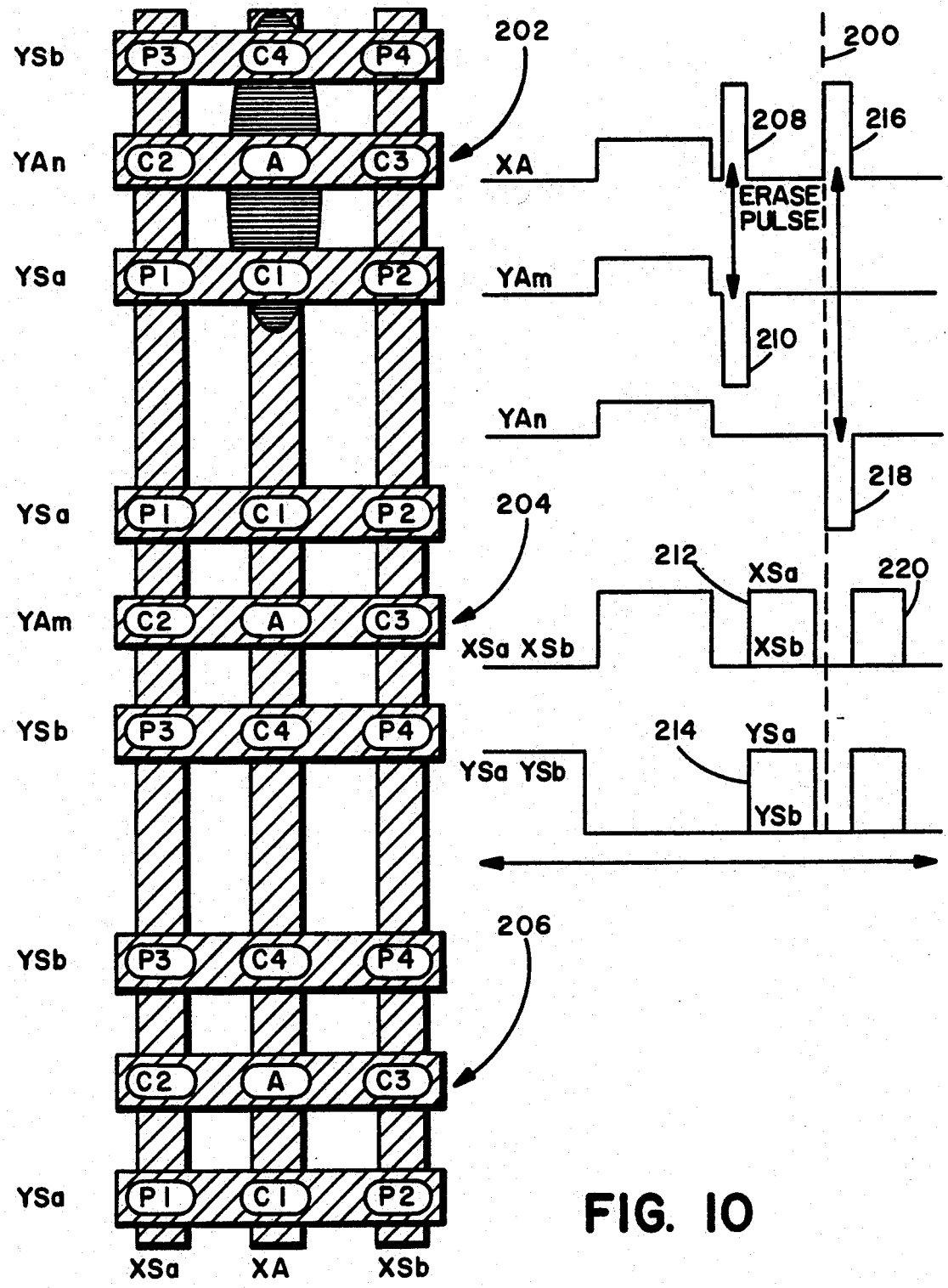
FIG. 10 is similar to FIGS. 8 and 9 but illustrates a Step 1 discharge at a different address cell.

Turning to FIG. 10, the second address portion of a basic cycle will be considered. Under these circumstances, assume that erase pulse 216 is applied to XA address line and erase pulse 218 to YAn address line. These pulses combine to discharge address cell A in cell group 202, causing the aforestated Step 1 type discharge effects to deposit wall voltages in coupling cells C1 and C4. It will be recalled from FIG. 9, that the application of XSa and YSa sustain pulses 212 and 214 caused pixel cell P2 in cell group 204 to discharge. Those same sustain pulses caused all P2 cells (which were in the on state) to also discharge and to reverse their wall charge states. Thus, until a subsequent basic cycle (when P2 cell wall charges have been reset by a subsequent sustain half cycle,) pixel cells P2 anywhere on the panel cannot be erased. Thus, either pixel cells P1, P3, or P4 can now be erased.

Figure 11:
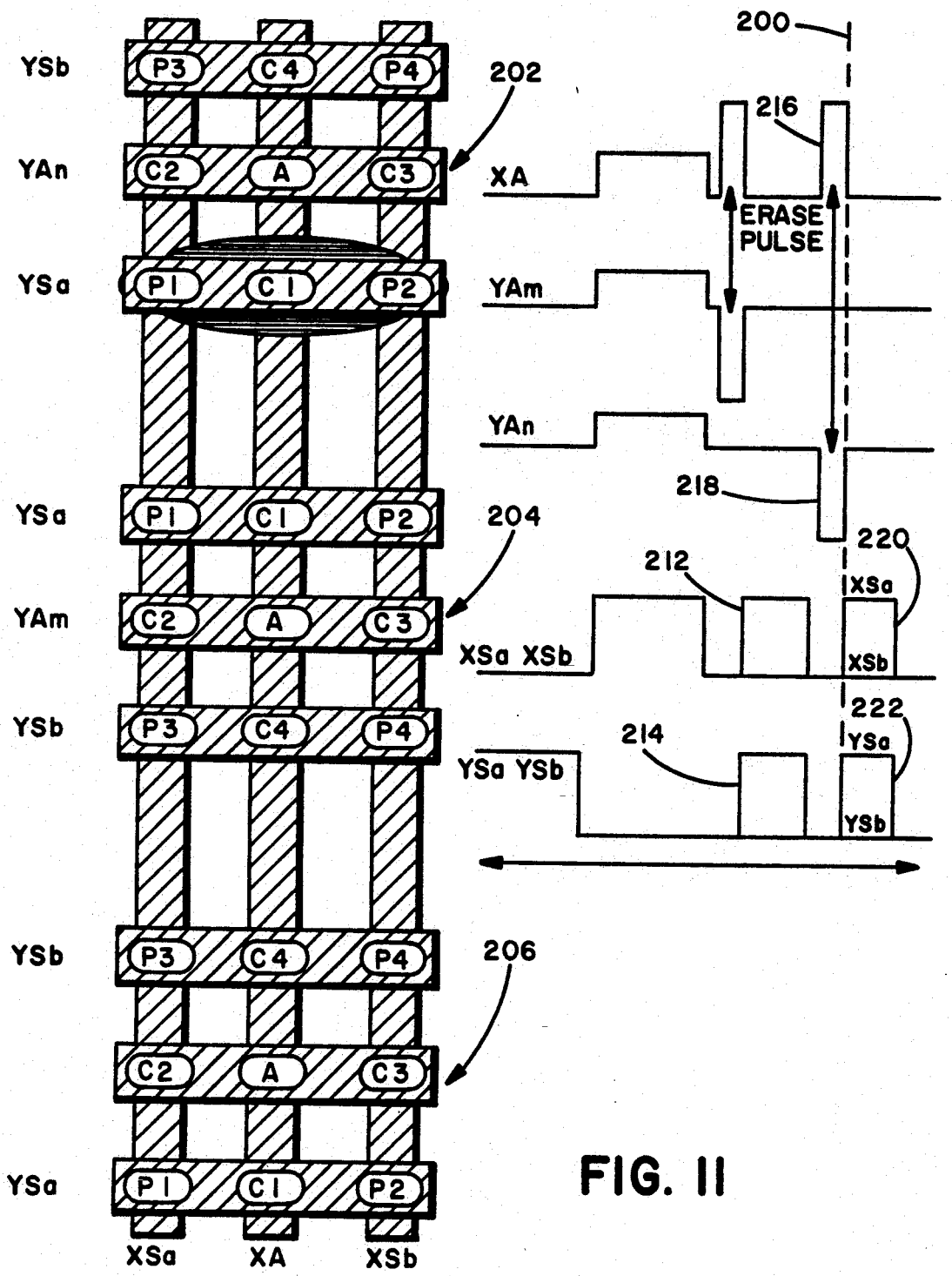
FIG. 11 illustrates a Step 2 discharge subsequent to the Step 1 discharge of FIG. 10.

Assuming that pixel cell P1 in cell group 202 is chosen for erasure, the time line 200 moves to the point shown in FIG. 11 and up levels are applied to the XSa and YSa sustain lines as shown by pulses 220 and 222. As a result, pixel cell P1 in cell group 202 is erased by the spread of electrons into its cell structure. The plasma does not spread into pixel cell P2 as that cell was discharged at an earlier time and its wall voltage is less positive than that in pixel cell P1. Therefore the plasma spread is preferentially to P1. It is to be noted that sustain pulses 220 and 222 are substantially shorter in duration than sustain pulses 212 and 214 since they do not have to assure the proper discharge of the P2 pixel cell. This substantially foreshortens the address time and enables a more rapid panel update.

From the above, it can be seen that the two succeeding erase pulses enable a first kind of pixel cell in a cell group to be erased, followed by a second kind of pixel cell in either the same cell group or in another cell group. The one constraint is that a pixel cell type present on the same Y sustain line as an erased pixel cell cannot be erased until it is reset by subsequent sustain half cycle. As a result, two different kinds of pixel cells can be erased during each basic cycle, and a second basic cycle is required to erase the other two different kinds of pixel cells. In any one basic cycle, however, as many as desired of the same two kinds of pixel cells may be erased in different cell groups. For each subsequent erasure, the erase pulse is followed by a foreshortened sustain level pulse.

Figure 12:
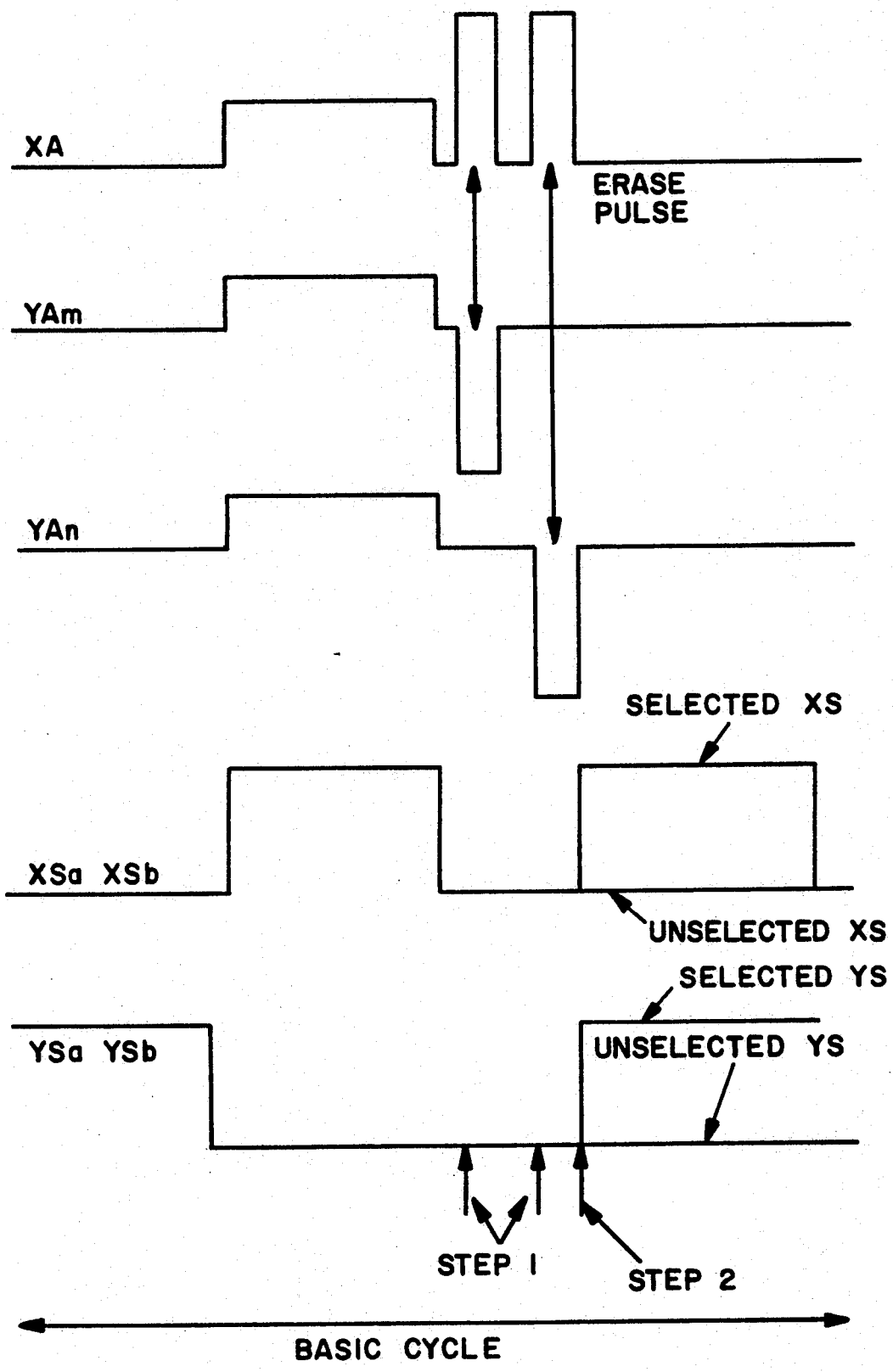
FIG. 12 is a general waveform diagram illustrating an alternative selective erase addressing scheme in accordance with the invention.

A second solution to the problem of decreasing the amount of time required to update the state of a pixel is shown in the waveforms of FIG. 12. This approach does not have multiple independent address cycles per basic cycle. Instead, it uses multiple independent Step 1 erase cycles and only a single incidence of a Step 2 cycle. In this approach, all pixel cells erased in a single basic cycle must be of the same type. Furthermore, each Step 1 erase pulse must be impressed on a different YA address line.

At each erase pulse (Step 1 discharge) in FIG. 12, a discharge occurs in a selected row of address cells. The plasma from those discharges spreads vertically into vertical coupling cells in a fashion identical to that illustrated in FIG. 5. The wall charges deposited in those cells remains until a Step 2 discharge occurs. When the Step 2 discharge does occur, there will be multiple vertical coupling cell discharges at different points on the panel. These discharges will cause the spread of plasmas much like that illustrated in FIGS. 6*a*, 6*b*, 6*c*, and 6*d*. The important point is that selected vertical coupling cells hold the wall charges deposited into them during Step 1. These cells are thus preset for a future Step 2 discharge, which will use stored wall charges in the vertical coupling cells to cause discharges that erase selected pixels.

Figure 13:
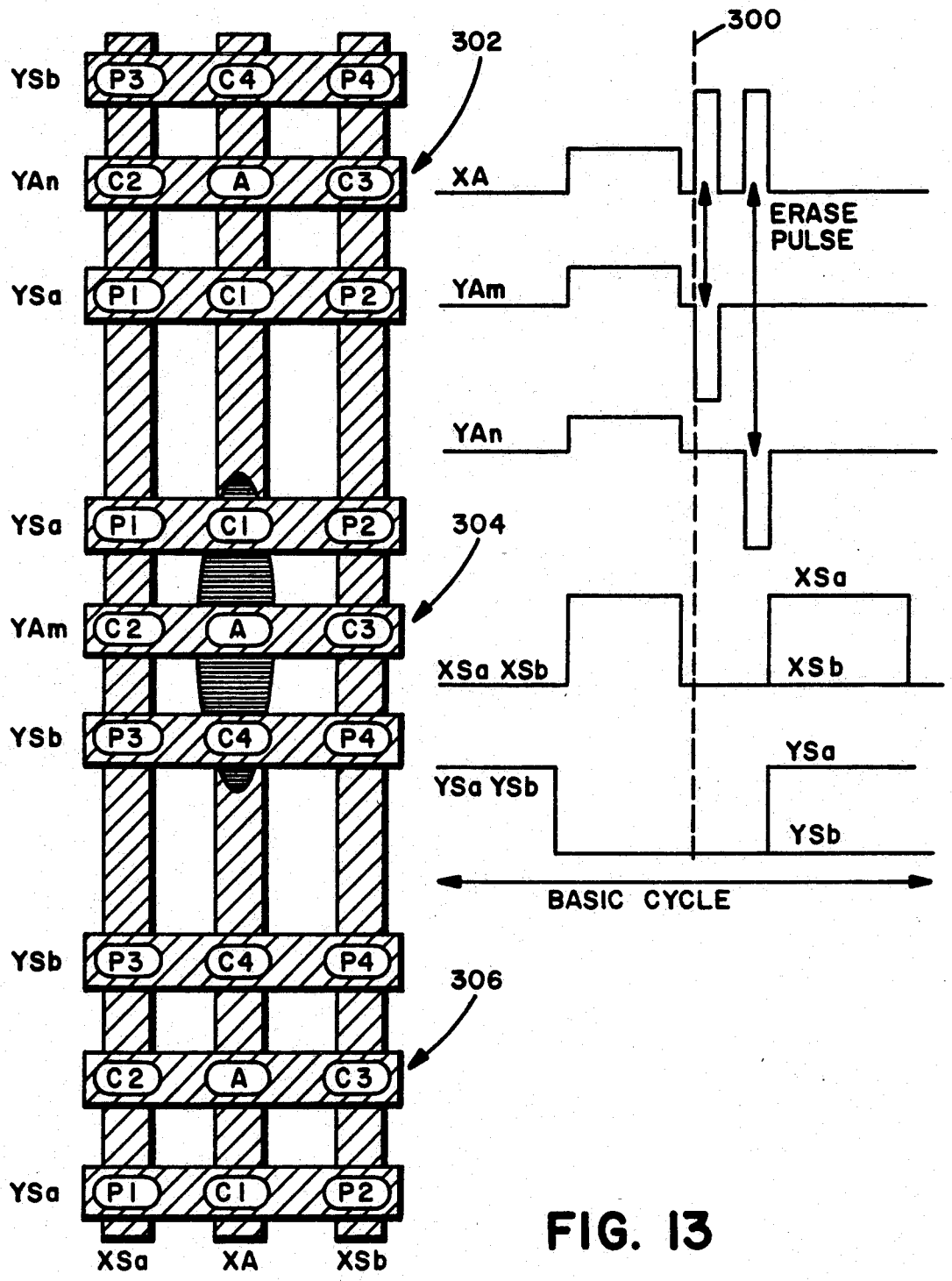
FIG. 13 illustrates three cell groups and the waveforms required to execute the alternative addressing scheme, the waveforms indicating a Step 1 discharge at an address cell.
Figure 14:
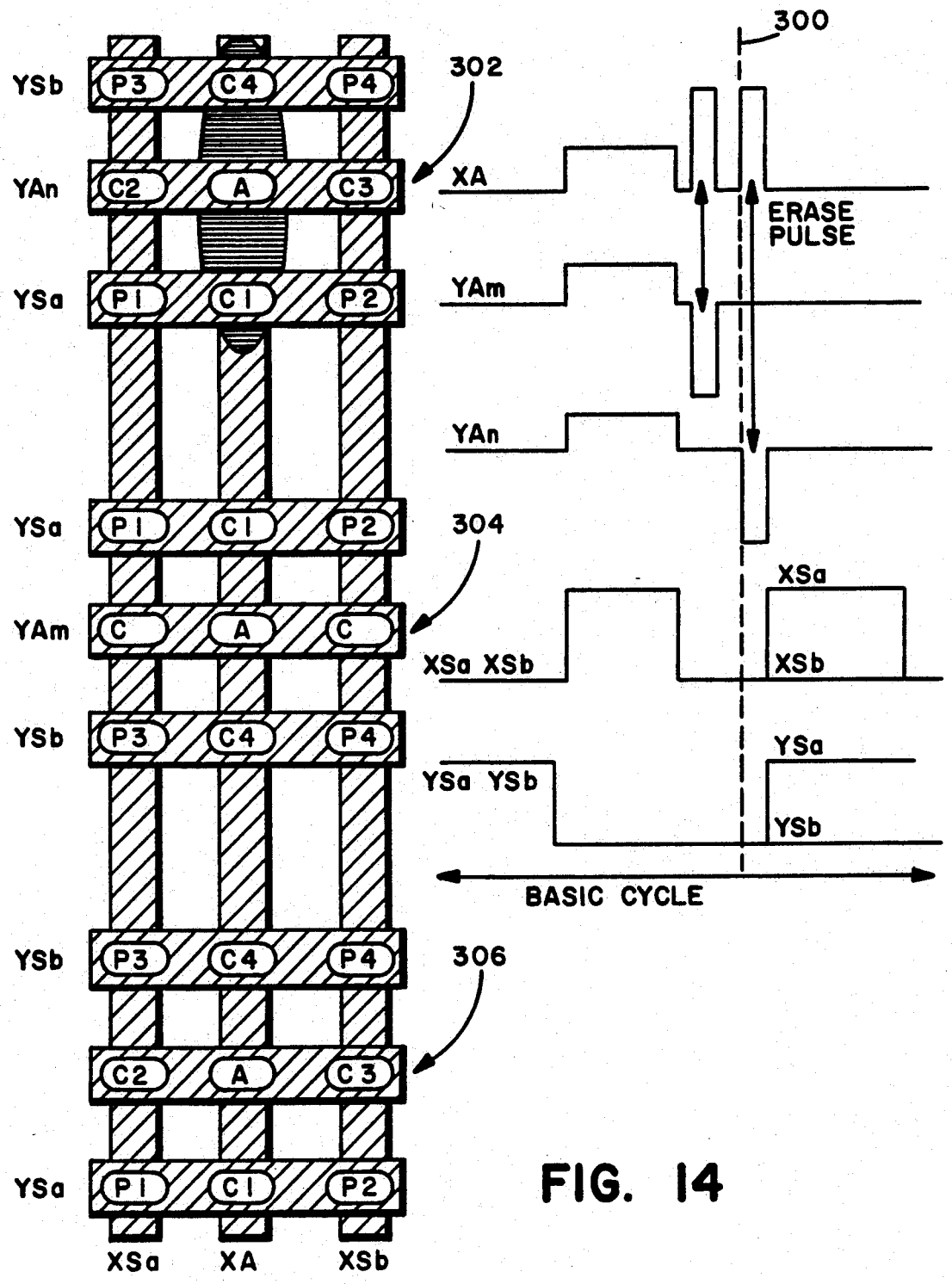
FIG. 14 is similar to FIG. 13 but shows a Step 1 discharge taking place subsequent to a previous Step 1 discharge shown in FIG. 13.
Figure 15:
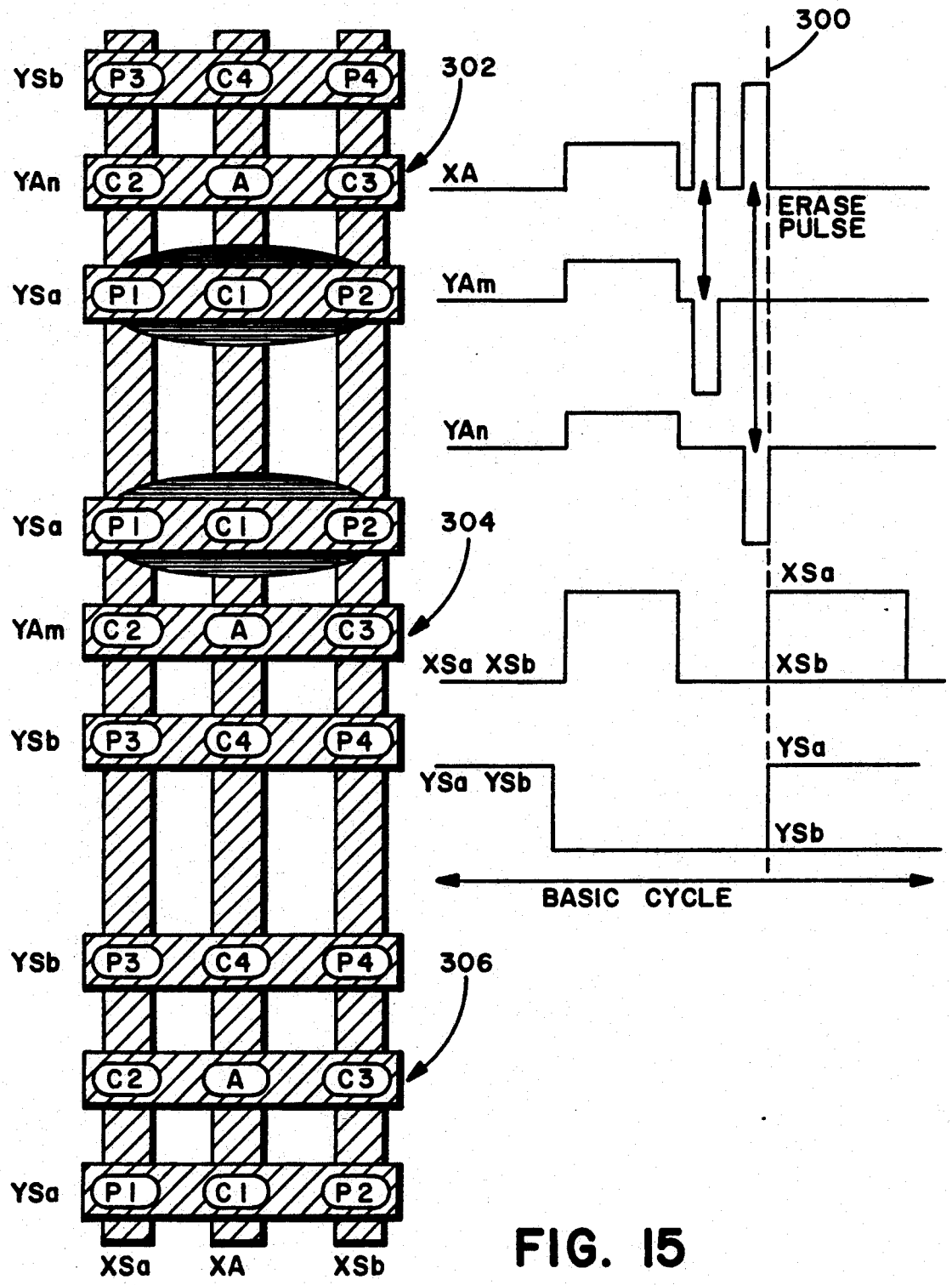
FIG. 15 indicates the alternative address scheme at a time later in the addressing cycle when two Step 2 discharges simultaneously take place.

FIGS. 13–15 illustrate the sequence of events that take place in a multiple address, basic cycle as above described with respect to FIG. 12. Adjacent each of the illustrations of plasma spread, are the waveforms which accomplish the address event. In each figure, a time line 300 indicates at what point in the waveforms the event is taking place.

In FIG. 13, one row of address cells is selectively subjected to a Step 1 type discharge by the application of erase pulses on XA and YAm lines. As a result, a discharge occurs in address cell A in cell group 304 with the plasma spreading into vertical coupling cells C1 and C4.

In FIG. 14, an identical Step 1 discharge occurs at the intersection of address line XA and address line YAn. This subsequent address erase pulse occurs shortly after the first erase pulse described with respect to FIG. 13.

FIG. 15 illustrates the application of sustain potentials via sustain lines XSa and YSa to cell groups 302, 304 and 306. These potentials result in Step 2 discharges occurring in coupling cells C1 in cell groups 302 and 304. The resulting Step 2 discharges cause a migration of charge into the pixel cell being erased and, further, enable the discharge of the adjacent pixel cell if it is in the "on" state. Note that these Step 2 discharges occur in the same type of vertical coupling cell, namely C1. This is because all vertical coupling cells receive the same Step 2 waveforms, which waveforms determine which vertical coupling cell and pixel cell type is selected.

After the Step 2 discharges, all of the selected pixel cells, in this case P1, in the selected rows have been updated to their new state, either "on" or "off" according to the image data.

In the ISA plasma panel, the brightness of the display and the power that the display consumes are virtually directly proportional. Lowering or raising one or the other of these parameters will directly affect the other. For example, for a given image on an ISA plasma panel display, if the brightness is increased by a factor of 2, then the power will also increase by a factor of 2. The instantaneous power usage, for a given brightness, is almost linear with the number of pixels "on".

Prior art AC plasma panels have employed several approaches to controlling panel power consumption, i.e., adjusting the sustain frequency or time modulating the "on" pixels. The first approach involves adjusting the sustain frequency so that there are fewer sustain discharges in a discrete period of time. The second approach i.e., time modulating "on" pixels, can be used to achieve virtually any maximum power and brightness level desired. The latter approach, however, can add flicker to the display. Time modulating the "on" pixels involves leaving the "on" pixels "on" for some portion of the frame time and then erasing the entire row of pixels. The fraction of the frame time that the pixels are left "on" determines the brightness and also the power consumed by the panel. In an ISA AC plasma panel, the time modulation technique is implemented by an "erase two rows" of pixels simultaneously, and is somewhat similar to the "write two rows" that is used to turn two rows of pixels "on" at the same time. The "erase two rows" operation can be performed at any time during the frame time, and the closer the erase operation occurs to the raster line which is being written on the face of the AC plasma panel, the less bright will be the display.

Figure 16:
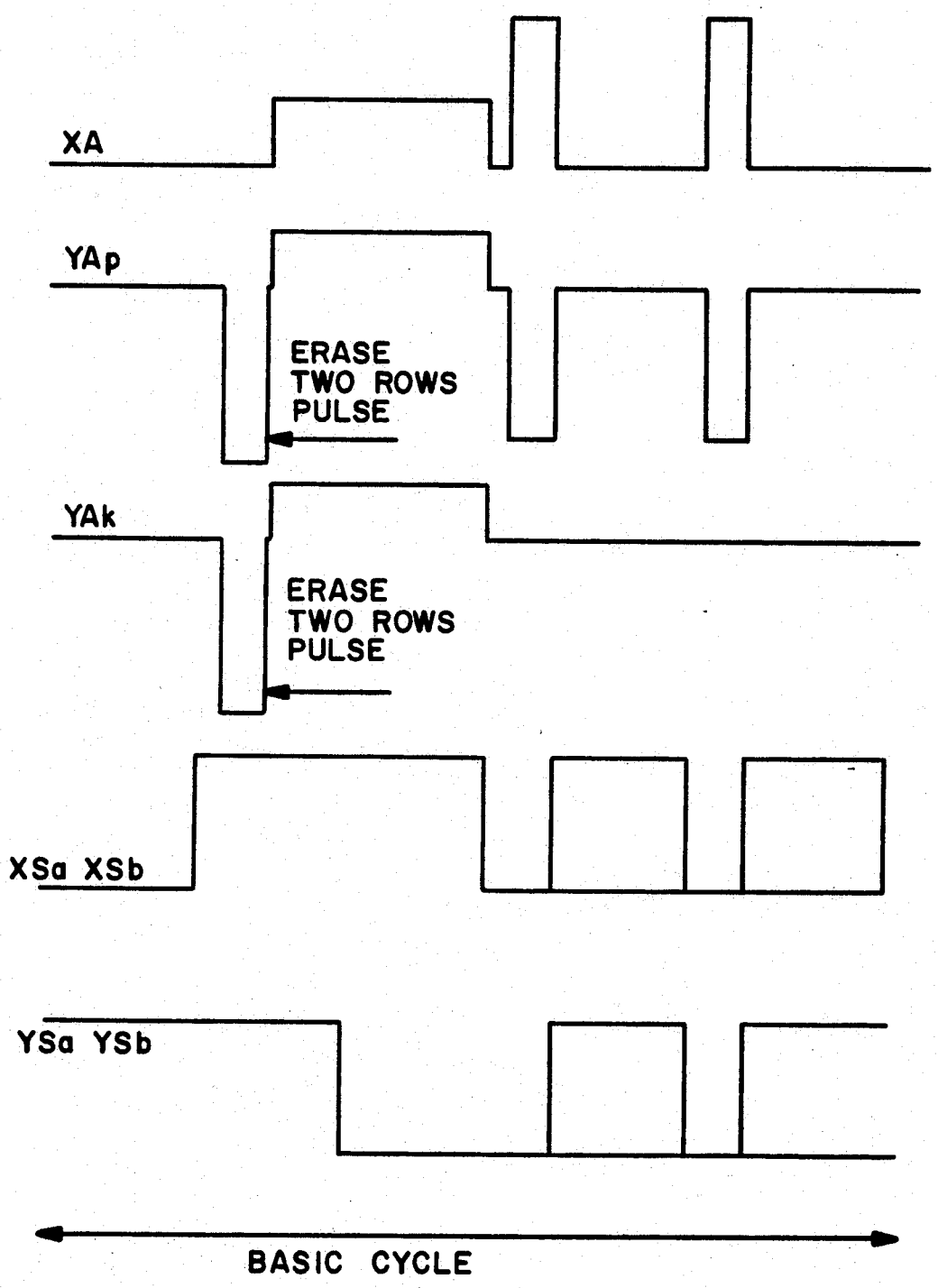
FIG. 16 is a general waveform diagram showing the operation of an erase two rows method employed with an ISA plasma panel for power conservation purposes.
Figure 17:
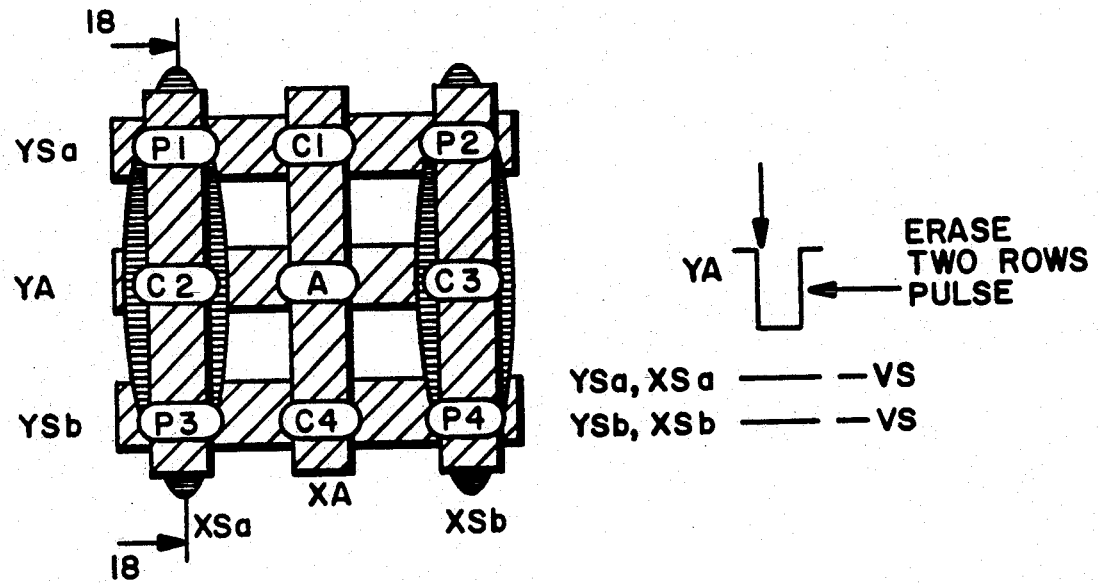
FIG. 17 is a showing of a cell group indicating the operation of the erase two rows technique.

The waveforms in FIG. 16 illustrate the "erase two rows" operation. Note that the XA address lines are not involved with this operation. As shown in FIG. 16, erase pulses are applied via pulse generator YAp to address line YAk. FIG. 17 shows the events which occur from the application of these Y address waveforms and indicates that horizontal coupling cells C2 and C3 are caused to simultaneously discharge. As can be seen from FIG. 16, the waveforms that cause these discharges are arranged such that the XS electrodes are the anodes for the discharge and the YA electrodes are the cathodes. With this polarity of discharge, the plasma spreads vertically towards display pixels on either side of the horizontal coupling cells. Subsequently applied sustain waveforms are adjusted so that there is only a minimal voltage present across the gas in any "off" pixel cell. However in any "on" pixel cell, there is a voltage applied across the gas which is very near the sustain voltage. This difference between "on" and "off" pixel cells and its affect can be seen in FIGS. 18*a*–18*d*.

Figure 18A:
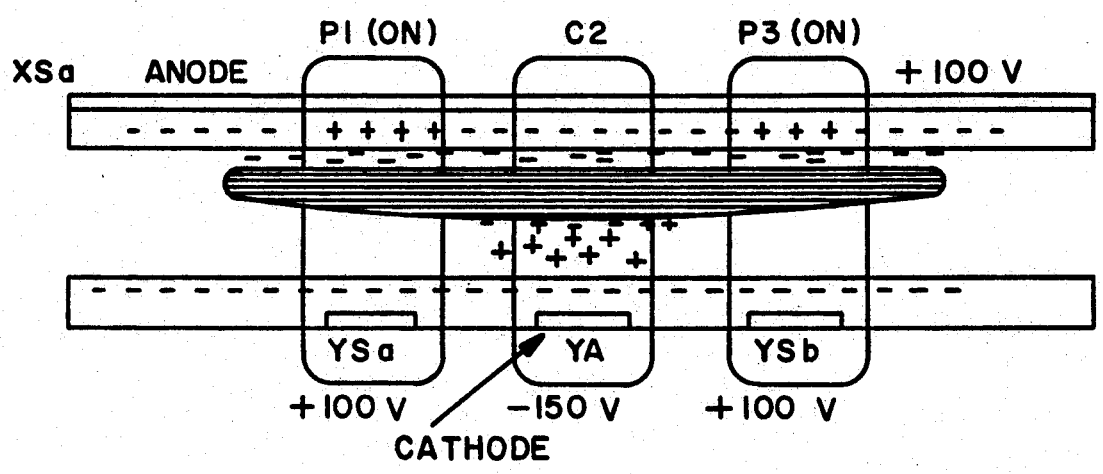
Figure 18B:
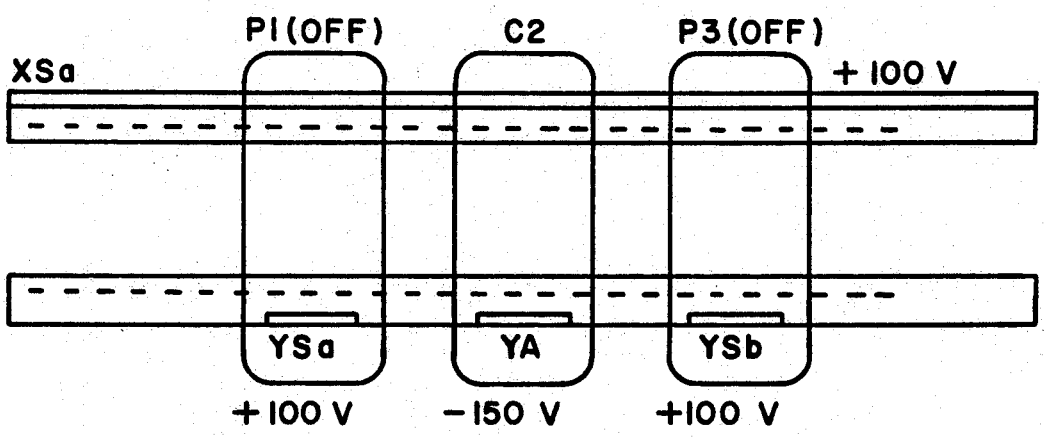

Each of FIGS. 18*a*–18*d* illustrates a section of the panel of the FIG. 17 taken along line 18—18. FIG. 18*a* illustrates when the pixels above and below a coupling cell are both initially "on", and further indicates the effect during the discharge of coupling cell C2. FIG. 18*b* indicates the state of erased pixel cells P1 and P3 after the discharge has extinguished itself.

Figure 18C:
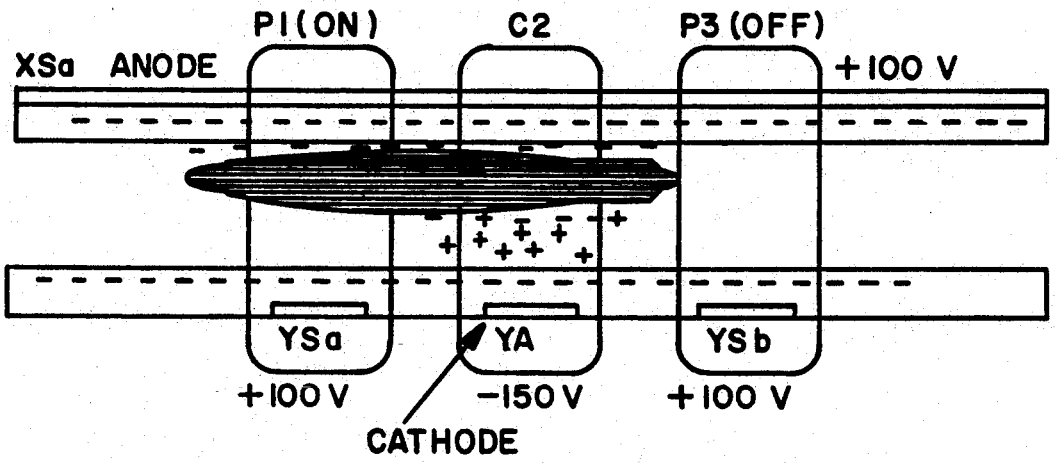
FIGS. 18*c* and 18*d* are sectional views taken along line 18—18 in FIG. 17 and show the erase two rows method when one pixel cell is on and the other is off.
Figure 18D:
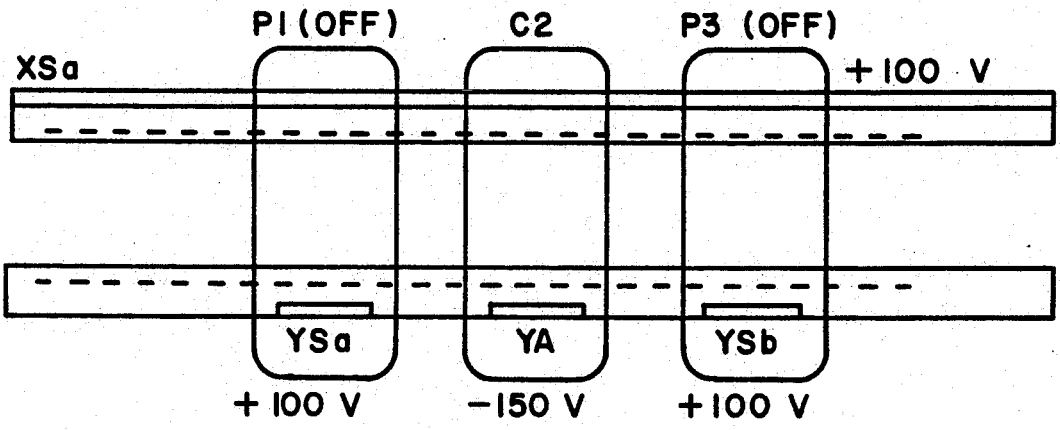

FIGS. 18*c* and 18*d* further illustrate the situation where one of the pixel cells is initially "off" and the other pixel cell is initially "on". The plasma that spreads along the anode of the coupling cell deposits negative charge onto the dielectric covering the anode electrode. The amount of charge deposited depends upon the potential across the gas in the pixel cell that is encountered.

In the case shown in FIGS. 18*c* and 18*d*, the plasma spreading away from horizontal coupling cell C2 towards pixels P1 and P3 will zero the voltage across the gas in pixel cell P1 (the on pixel). It can be seen from the diagram of FIG. 18*c*that it is the positive wall charges in pixel cell P1 which largely influence the direction of movement of the electrons created by the discharge in coupling cell C2. Since there is no similar wall charge state in the "off" pixel cell P3, the plasma does not affect that cell.

After the plasma dissipates, pixels that were "on" will now have zero volts across the gas, just like "off" pixel cells. Thus, pixel cells that were "on" will now no longer discharge upon the application of sustainer voltages and such pixel cells are now "off". Using this technique, both the brightness level and power consumption can be significantly varied in an ISA AC plasma panel.

It should understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A method for driving an Independent Sustain and Address line, Alternating Current (ISA AC) plasma display panel, wherein said panel comprises at least two cell groups, each said cell group including an address cell, two vertical coupling cells, two horizontal coupling cells and four pixel cells, horizontal and vertical address lines intersecting each said address cell, and parallel sustain lines positioned on either side of each said address line and intersecting adjacent series of pixels and coupling cells in each cell group, said method comprising:

a. energizing said address and sustain lines to turn on all said four pixel cells in a said cell group;

b. applying an erase potential to an address cell, to thereby cause a first said coupling cell to have wall charges deposited therein;

c. applying next, a preset duration potential between intersecting sustain lines, one said sustain line intersecting said first coupling cell and first and second adjacent pixel in a said cell group, to migrate electrons from a discharge of said first coupling cell to a said first adjacent pixel cell, to thereby erase said first adjacent pixel cell, said preset duration potential further causing said second adjacent pixel cell, if it is "on", to discharge;

d. applying next, another erase potential to a said address cell to cause a different said coupling cell to have wall charges deposited therein; and e. applying next, a laser duration potential than said preset duration potential, between a pair of intersecting sustain lines to migrate said wall charges to a said pixel cell adjacent said different coupling cell to erase said pixel cell, said lesser duration potential being insufficient to cause another pixel cell adjacent said different coupling cell to discharge.

2. The method as defined in claim 1 wherein said erase potential is applied to an address cell in one cell group and said another erase potential is applied to an address cell in another cell group.

3. The method as defined in claim 2 wherein parallel and adjacent sustain lines are connected in pairs, each pair lying between parallel address lines and intersecting adjacent series of pixels and coupling cells in adjacent cell groups and wherein said preset duration and lesser duration potentials are applied to adjacent and parallel pairs of sustain lines.

4. The method as defined in claim 3 wherein one kind of pixel cell in one cell group is defined by the intersection of one of a first pair of horizontal, connected sustain lines and one of a first pair of vertical, connected sustain lines, and an identical kind pixel cell in another cell group is defined by the intersection of another of said first pair of horizontal, connected sustain lines and said one of said first pair of vertical, connected sustain lines, and wherein said method further comprises:

f. sequentially erasing identical kind pixel cells in different cell groups.

5. The method as defined in claim 1, wherein one kind of pixel cell in one cell group is defined by the intersection of one of a first pair of horizontal, connected sustain lines and one of a first pair of vertical, connected sustain lines, and an identical kind of pixel cell in another cell group is defined by the intersection of another of said first pair of horizontal, connected sustain lines and said one of said first pair of vertical, connected sustain lines, and wherein said method further comprises:

f. sequentially erasing identical kind pixel cells in different cell groups.

6. The method as defined in claim 1, wherein one kind of pixel cell in one cell group is defined by the intersection of one of a first pair of horizontal, connected sustain lines and one of a first pair of vertical, connected sustain lines, and an identical kind pixel cell in another cell group is defined by the intersection of another of said first pair of horizontal connected sustain lines and said one of said first pair of vertical connected sustain lines, said method causing different kinds of pixel cells to be erased, said method including additional steps c1 and d1 instead of steps c and d, as follows: p1 c1. applying next, an erase potential to an address cell to cause another vertical coupling cell, other than said first coupling cell, to have wall charges deposited therein; and d1. applying next, a preset duration potential between intersecting sustain lines that define a different kind pixel cell adjacent said another vertical coupling cell, to migrate electrons resulting from a discharge of said another coupling cell to said different kind pixel cell, to erase said different kind pixel cell, said potential further causing an "on" pixel cell adjacent said another coupling cell to discharge.

7. A method for driving an Independent Sustain and Address line, Alternating Current (ISA AC) plasma display panel wherein said panel comprises a plurality of cell groups, said groups assayed in lines across said display, each said cell group including an address cell, two vertical coupling cells, two horizontal coupling cells, and four pixel cells, horizontal and vertical address electrodes intersecting each said address cell, and connected pairs of parallel sustain electrodes on either side of each said address line, each said pair of sustain electrodes intersecting parallel and adjacent series of pixel and coupling cells in adjoining cell groups, said method comprising:

a. energizing a horizontal address electrode which intersects horizontal coupling cells in all cell groups in a said line, to thereby discharge said horizontal coupling cells and to deposit wall charges in both pixel cells adjacent thereto in each said cell group in said line; and b. simultaneously applying sustain potentials to horizontal and vertical sustain electrodes which intersect all pixel cells in each said cell group along said line, to thereby simultaneously erase all pixel cells in each said cell group along said line, whereby two lines of pixels are erased.

8. The method is defined in claim 7 wherein said erase step b is operated prior to all lines of said plasma display panel being scanned to display an image.

* * * * *

UNITED STATES PATENT AND TRADEMARK OFFICE

CERTIFICATE OF CORRECTION

PATENT NO. : 5,247,288

DATED : 09/21/93

INVENTOR(S) : Warren et al

It is certified that error appears in the above-indentified patent and that said Letters Patent is hereby corrected as shown below:

Column 12, line 4, claim 6, omit "p1" after "as follows:" and begin a sub-paragraph before "c1".

Column 12, line 19, claim 7, replace the word "assayed" with the word --arrayed--.

Signed and Sealed this

Twenty-second Day of March, 1994

*Attest:*

*Attesting Officer*

BRUCE LEHMAN

*Commissioner of Patents and Trademarks*